US005393346A

United States Patent [19]

Cholewa

[11] Patent Number: 5,393,346

[45] Date of Patent: Feb. 28, 1995

[54] APPARAUTS FOR COATING FASTENERS

[75] Inventor: Randall B. Cholewa, Birmingham, Mich.

[73] Assignee: The Magni Group, Inc., Birminham, Mich.

[21] Appl. No.: 67,288

[22] Filed: May 25, 1993

[51] Int. Cl.[6] ..... B05B 13/04; B05C 5/00

[52] U.S. Cl. ..... 118/320; 118/416; 427/425; 427/426; 427/242

[58] Field of Search ..... 118/300, 317, 319, 320, 118/416, 55; 427/242, 425, 426

[56] References Cited

U.S. PATENT DOCUMENTS 3,416,492 12/1968 Greenleaf ..... 118/320
4,056,644 11/1977 Howard et al. ..... 427/284
4,725,446 2/1988 Forster et al. ..... 427/3
4,773,244 9/1988 Honda et al. ..... 72/46
4,888,214 12/1989 Duffy et al. ..... 427/183
5,090,355 2/1992 Di Maio et al. ..... 118/681

*Primary Examiner*—Nina Bhat
*Attorney, Agent, or Firm*—Barnes, Kisselle, Raisch, Choate, Whittemore & Hulbert

[57] ABSTRACT

A method and apparatus for applying a liquid coating which can be cured to a dry film to a plurality of fasteners each with a blind recess therein without accumulating excessive coating in the blined recesses. The fasteners are received in a cage with a cylindrical sidewall which is rotated with its axis inclined at an acute included angle of about 25° to 65° to the vertical and a speed of 1 to 30 rpm to circulate the fasteners while the liquid coating is sprayed onto the fasteners in the rotating cage. The fasteners with a liquid coating thereon are heated to a temperature of about 325° F. to 425° F. for 10 to 30 minutes to cure the coating to a dry film adhered to each fastener.

7 Claims, 2 Drawing Sheets

APPARAUTS FOR COATING FASTENERS

FIELD OF THE INVENTION

This invention relates to coatings and more particularily to applying a liquid coating to a fastener with a blind recess and curing the coating to a dry film adhering to the fastener.

BACKGROUND OF THE INVENTION

Previously corrosion resistant liquid coatings have been applied to steel fasteners such as bolts by placing a quantity of bolts in a cage with a perforate bottom and a cylindrical sidewall, dipping the cage and bolts in a pool of liquid coating, and then rotating the cage with the bolts therein at a relatively high speed of about 200 to 500 RPM to remove excess liquid coating from the bolts by centrifugal force. Thereafter the coated bolts were removed from the cage and heated in a furnace to a peak metal temperature of 325° to 450° F. for about 20 minutes to cure the liquid coating to a dry film adhered to the bolts. Previously the liquid coating has also been applied by rotating a cage with a quantity of bolts therein while pouring a stream of liquid coating on the bolts. After sufficient coating has been poured to cover all of the bolts, rotation of the cage is continued to remove excess coating from the bolts by centrifugal force.

These previously known methods cannot satisfactorily apply a liquid coating to fasteners having a blind hole or recess therein such as a socket in the head of a fastener for driving it. Typically these internal drive sockets are known as Torx, Phillips, Cross, Hex, Allen, Robertson, and the like head screws, cap screws, bolts, and other fasteners. With these prior methods excess liquid coating accumulates in the blind holes or sockets and when cured results in a dry film which is too thick. The thick dry film often makes it more difficult to insert a driving tool in the socket and more importantly is frequently scraped off the fastener or scratched sufficiently so that its ability to provide corrosion resistance is greatly impaired and frequently destroyed. If the coating is intended to provide a desired color or finish for decorative purposes, this scraping or scratching is also unacceptable.

Because the results of these previous methods were unacceptable, fasteners with blind holes or sockets had to be electroplated at considerable cost with metal coatings such as nickel and chrome to provide satisfactory corrosion resistance and/or decorative appearance.

SUMMARY OF THE INVENTION

A method of applying a liquid coating to a plurality of fasteners with blind recesses by disposing a body of the fasteners in a cage with a cylindrical sidewall, rotating the cage with its axis inclined to the vertical at an acute included angle preferably of about 30° to 60° to circulate the fasteners in the body, spraying a liquid coating into the rotating cage and onto the circulating fasteners to coat substantially all of the fasteners including the blind recesses without accumulating excessive liquid coating in the blind recesses. Subsequently, the applied liquid coating is cured to a dry film adhered to the fasteners without excessive coating in the recesses by heating the fasteners to an elevated temperature to cure the coating.

Preferably the cage is rotated at about 5 to 30 rpm while the liquid coating is sprayed for about 30 to 120 seconds at a rate by volume of about 1500 to 3000 ml per hour. Preferably the liquid coating has a viscosity of about 20 to 30 seconds in a Zahn #2 cup and is sprayed from a spray gun actuated by compressed air at a pressure of about 60 to 120 psig. Preferably the batch or body of fasteners collectively weigh about 100 to 150 pounds.

An apparatus for applying the liquid coating has a turntable pivotally carried by a base and constructed to removably receive and rotate a cage with a cylindrical sidewall and an actuator to pivot the turntable and cage to a first vertically upright position for loading and unloading the cage and to a second inclined position wherein a spray gun sprays liquid coating on circulating fasteners in the rotating cage. In the first position the axis of rotation of the cage extends generally vertically and in the second position at an acute included angle of about 25° to 65° to the vertical. Preferably the spray gun is mounted to move to an operable position when the cage is in the second position and to a spaced apart clearance position when the cage in in the first position to facilitate loading and unloading the cage. Preferably the turntable and cage are received in a housing through which air is circulated to exhaust sprayed coating particles which do not adhere to the fasteners and vapors of vehicles and solvents.

Objects, features and advantages of the method and apparatus of this invention include applying and curing a liquid coating on fasteners with blind recesses without excessive coating therein, applying a substantially uniform and relatively thin layer of polymer coating, providing improved adhesion resistance to marring, scraping and scratching, quality, corrosion protection and decorative appearance for coated fasteners, and achieves high production rates and is economical, reliable, repeatable, relatively simple, and requires little labor and modest capital investment.

BRIEF DESCRIPTION OF THE DRAWINGS

These and other objects features and advantages will be apparent in view of the following detailed description of the preferred embodiment and best mode of the invention, appended claims, and accompanying drawings in which:

DETAILED DESCRIPTION

Figure 1:
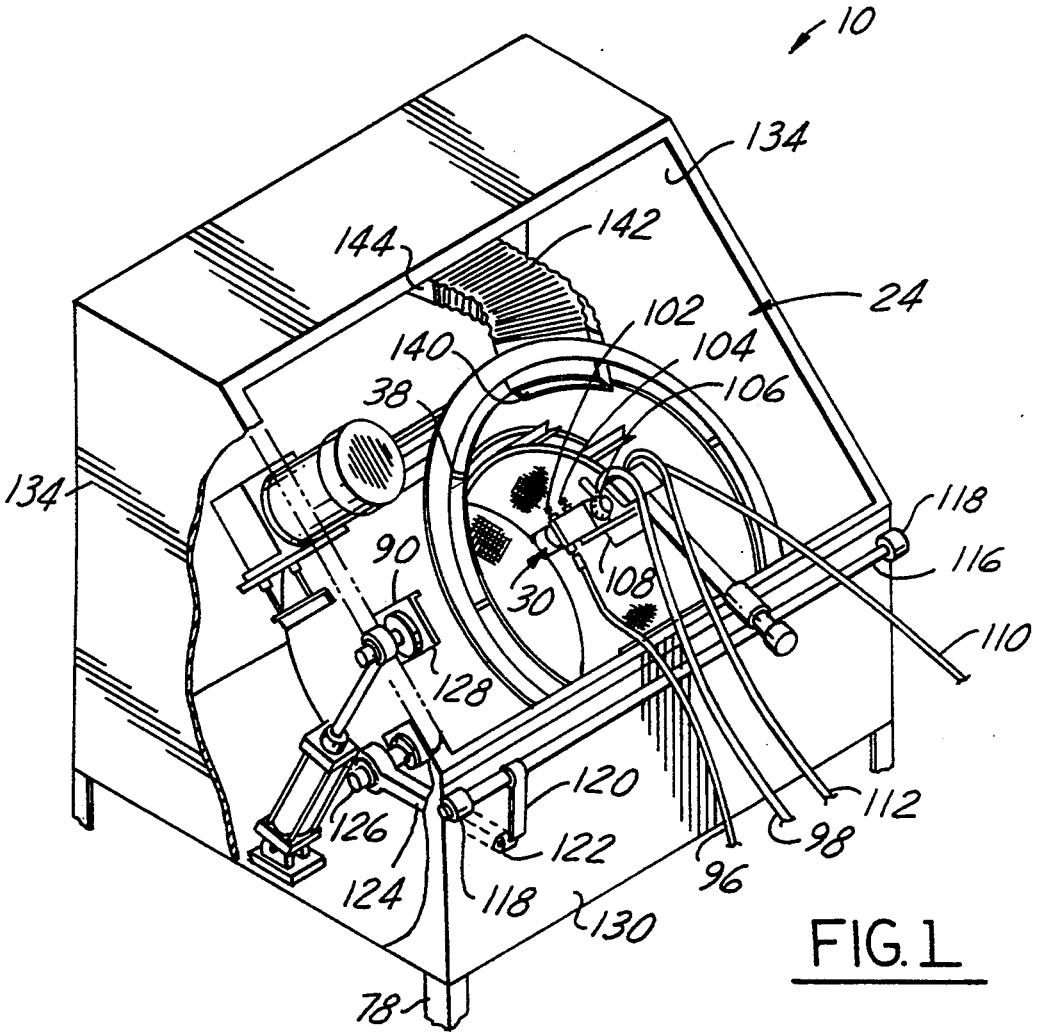
FIG. 1 is a perspective view of an apparatus for carrying out the method of this invention.

In the method, a liquid coating curable to a dry film is applied to to the exterior surface of a plurality of workpieces with blind recesses, such as fasteners, by circulating them, spraying the liquid coating on them while they are circulating to coat them without accumulating excess liquid coating in the recesses, and subsequently curing the liquid coating to a dry film adhered to the workpieces preferably by heating them to an elevated temperature. Preferably, the fasteners are circulated by disposing a body of them in a rotating cage or drum with a cylindrical side wall and its axis of rotation inclined to the vertical at an acute included angle of 25° to 65°, usually 30° to 60°, desirably 35° to 55°, preferably 40° to 50° and about 45°. The cage is rotated at about 1 to 30 RPM, usually 5 to 25 RPM and preferably 10 to 20 RPM.

Typically the sidewall of the cage has an inside diameter of about 20 to 30 inches and preferably 24 to 27 inches. A typical quantity, batch or body of steel fasteners disposed in the cage has a total weight of about 100 to 150 pounds.

Preferably the liquid coating is sprayed at a rate of 1500 to 3000 and preferably 2000 to 2500 milliliters per hour (ml/hr) by volume of coating and vehicle for a period of time of 30 to 120 and preferably 60 to 90 seconds. Preferably the liquid coating has a viscosity in the range of about 20 to 30 seconds and preferably 22 to 26 seconds in a Zahn #2 cup. Preferably the liquid coating is sprayed by a spray gun operating with compressed air at a pressure of about 40 to 120 and preferably 60 to 80 pounds per square inch gauge (psig).

In some applications uniformity of the thickness, color, appearance and corrosion protection of the cured adhered coating can be improved by prewetting the fasteners with a compatible solvent just before the liquid coating is sprayed on the fasteners. Preferably the solvent is sprayed onto the circulating fasteners in the rotating cage by a spray gun. Prewetting the fasteners is believed to improve the flow characteristics of the applied liquid coating and to substantially reduce and usually virtually eliminate marring and streaking thereof by contact with adjacent fasteners. In some applications marring and streaking of the applied liquid coating can also be substantially reduced by preheating the fasteners before any solvent and the liquid coating is sprayed on them. Usually the fasteners are preheated to an elevated temperature in the range of about 100° to 150° F.

After each coat of liquid coating is sprayed onto the fasteners it is cured to a dry film or layer adhered to each fastener preferably by heating to an elevated temperature for a sufficient period of time to cure it. The coated fasteners are heated to to a peak temperature of about 325° to 425° F. and preferably 350° to 400° F. for 10 to 30 minutes and preferably 15 to 25 minutes. Preferably, the coated fasteners are poured from the cage onto a moving conveyor belt which passes them through an oven or furnace to heat them. Usually each cured coat or dry film has a nominal thickness of about 2/10,000 to 3/10,000 of an inch.

A wide variety of paints and other liquid coatings can be used depending primarily on the characteristics, properties and color desired of the cured coating adhered to the fasteners. Preferred decorative coatings may may consist of two coats of a liquid polymer with a suitable pigment providing the desired color and one or more clear topcoats of a liquid epoxy polymer. Preferred corrosion resistant coatings may consist of at least two coats of a liquid zinc rich coating with a linear epoxy polymer of the type disclosed in U.S. Pat. No. 4,391,855. If a black decorative color is desired which further enhances corrosion protection an additional two top coats of a liquid epoxy coating can be applied of the type disclosed in U.S. Pat. No. 4,544,581.

FIGS. 1–4 illustrate an apparatus 10 useful in practicing the method of this invention. In the apparatus, a cage 12 with fasteners 14 therein is carried by a turntable 16 mounted on a drive assembly 18 and received in a tub 20. The tub is pivotally mounted in a housing 22 with an access opening 24 and is tilted to inclined and generally vertical positions by a drive cylinder 26. The liquid coating 28 is applied by a spray gun 30 mounted on a carrier assembly 32 which moves the spray gun to an extended operable position (FIG. 1) and a retracted position (FIG. 4) in unison with tilting of the tub to its inclined and vertical positions.

Figure 3:
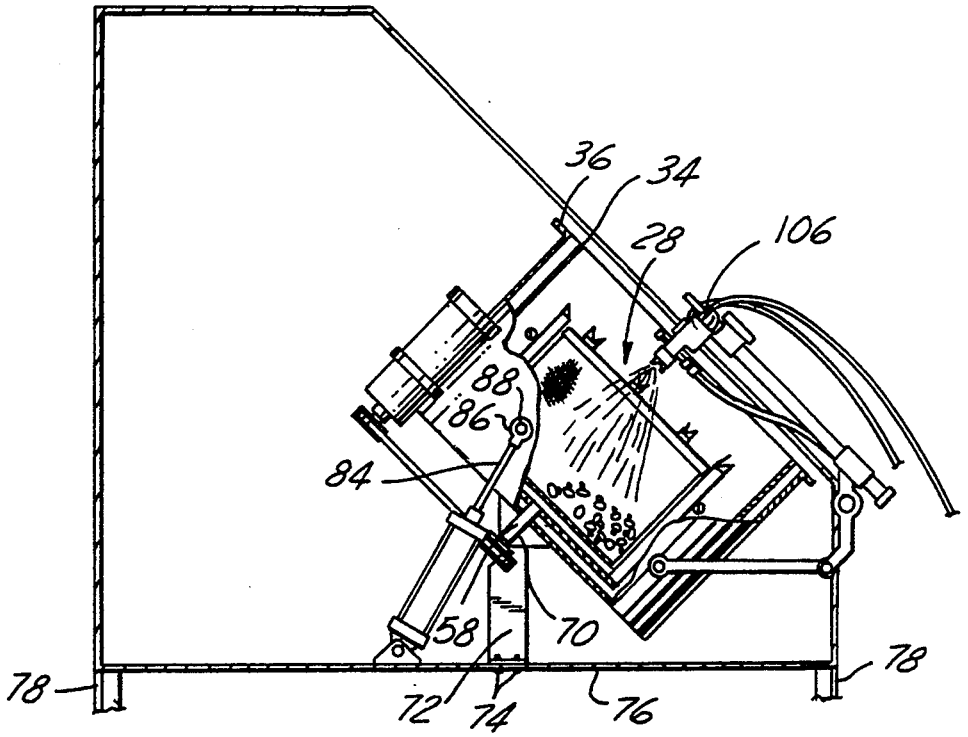
FIG. 3 is side view with portions broken away and in section of the apparatus of FIG. 1 and illustrating spraying of liquid coating on a body of fasteners received in a cage carried and rotated by a turntable of the apparatus.
Figure 4:
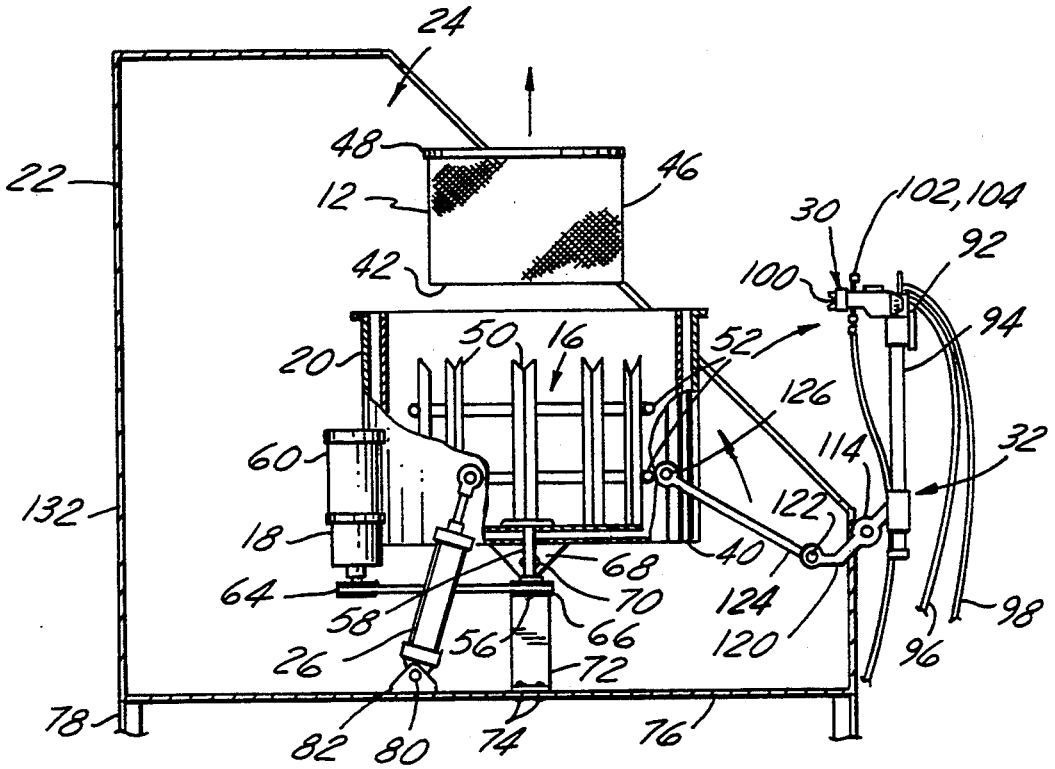
FIG. 4 is a side view with portions broken away and in section of the apparatus of FIG. 1 and illustrating removing a cage from the turntable.

As shown in FIGS. 3 & 4, preferably the tub 20 has spaced apart concentric inner and outer cylindrical sidewalls 34 & 36 of steel fixed to ribs 38 received between them and at their lower edges to a generally flat steel bottom 40. The cage 12 has a generally flat bottom steel plate 42 fixed to a cylindrical side wall 46 preferably of expanded metal with a reinforcing rim 48 fixed to its upper edge.

The cage 12 is removably received on the turntable 16 between a plurality of circumferentially spaced apart retainer posts 50 of angle iron fixed at their lower ends to the turntable and encircled by vertically spaced apart steel reinforcing rings 52 fixed to them. The turntable is attached to a hub 54 fixed to a shaft 56 journaled for rotation by thrust bearings (not shown) received in a casing tube 58 extending through the bottom of the tub and secured to it. The turntable is rotated by an electric motor 60 mounted on the sidewall 36 of the tub and operably connected to the shaft by a belt 62 and pulleys 64 & 66.

For tilting the turntable 16 and cage 12, a pair of diametrically space apart gusset plates 68 are fixed to the tub bottom wall 40 and pivoted on a pair of coaxial pins 70 fixed to support brackets 72 attached by cap screws 74 to a steel base plate 76 fixed to support legs 78. The tub, turntable and cage are pivotally moved in unison by actuating the pneumatic drive cylinder which is pivotally mounted on the base plate 76 by a pin 80 and bracket 82 and has its piston rod 84 pivotally connected to the tub by a clevis 86 journaled on a pivot pin 88 mounted on a bracket 90 fixed to the tub sidewall 36.

The spray gun 30 for the liquid coating is adjustably mounted on a bracket 92 fixed to one end of an arm 94 of the carrier assembly 32. Compressed air and liquid coating are supplied to the spray gun 30 through hoses 96 & 98 and the quantity of compressed air and liquid coating discharged from the nozzle 100 of the spray gun can by adjusted and varied within limits by needle valves 102 & 104. The spray pattern of the nozzle 100 can also be adjusted within limits by turning the control knob 106. If desired a second spray gun 108 for any solvent for prewetting of the fasteners can also be mounted on the bracket 92. Compressed air and solvent are supplied to this spray gun through the hoses 110 & 112. Suitable spray guns are commercially available as model No. AG-HV from the Hose Specialties Company of Detroit, Mich.

The arm 94 of the carrier assembly 32 is slidably received in a releasable clamp 114 which is slidably and releasably secured to a cross shaft 116 for rotation therewith. The cross shaft is journaled for rotation in bearing blocks 118 mounted on the housing. The shaft is operably connected to the tub 20 for movement of the spray guns 30 & 108 to their extended and retracted positions by a lever arm 120 fixed to the shaft and pivotally connected by a pin 122 to one end of a link 124 pivotally connected at its other end to the tub by a pin 126 mounted on a bracket 128 fixed to the tub sidewall 36. In operation the carrier assembly 32 moves the spray guns to their extended and retracted positions in response to movement of the tub 20 to its inclined and vertical positions by the drive cylinder 26.

The housing has an upstanding front wall 130, back wall 132 and sidewalls 134 connected together at their adjacent vertical edges and secured to the base plate along their lower edges. To provide access to the turntable 16 the housing has the large access opening 24 which is preferably inclined at about 45° to the vertical and is bounded by edges of the front wall, sidewalls and a top panel 136 extending between and fixed to the sidewalls and the backwall.

Preferably to remove airborne paint particles which do not adhere to the fasteners and vapors of any solvent and the vehicle of the coating an exhaust gas inlet 140 opens into the inner sidewall 34 of the tub 20 adjacent its upper edge and is connected by a flexible vent hose 142 to a duct 144 extending through the housing back wall 132 and connected to an exhaust fan or blower. Additional ventilation, dust collectors, scrubbers, etc. may be required to comply with local air quality regulations.

In using the apparatus, the cage 12 and tub 20 are moved to their vertical upright position shown in FIG. 4 by actuating the cylinder 26 to retract its piston rod. This also drives the carrier assembly 32 to move the spray guns 30 & 108 to their retracted position spaced from the tub. A cage 12 with fasteners 14 therein is loaded onto the turntable 16 by lowering it generally vertically between the retainer posts 50 of the turntable. The cage, turntable and tub are moved to their inclined position with the axis of rotation at an acute included angle to the vertical of preferably 45° by actuating the drive cylinder 26 to extend its piston rod. This also drives the carrier assembly 32 to move the spray guns to their extended operating position for spraying any prewetting solvent and liquid coating onto the fasteners. Preferably in the operating position the spray guns are disposed adjacent the axis of rotation and somewhat above the cage and oriented to direct the spray from their nozzles onto the body of fasteners disposed in the lowermost portion of the inclined cage.

Figure 2:
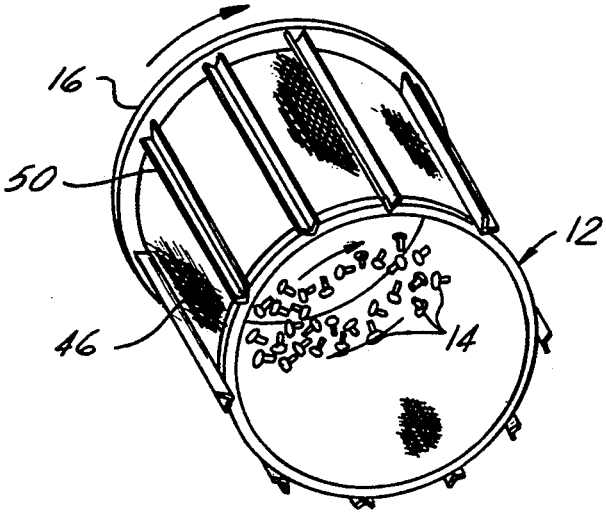
FIG. 2 is an enlarged and semischematic view illustrating circulation of fasteners for spraying of liquid coating on them by the apparatus of FIG. 1.

To circulate the fasteners in the lower portion of the inclined cage (as illustrated in FIG. 2) the electric motor 60 is energized to rotate the cage. Any solvent for prewetting the fasteners is sprayed onto the circulating fasteners by supplying liquid solvent and compressed air to the spray gun 108 at an appropriate rate and period of time. The liquid coating is sprayed onto the circulating fasteners including the recesses thereof by supplying liquid coating and compressed air to the spray gun 30 at the desired rate and period of time.

After spraying is completed the motor 60 is deenergized to cease rotation of the turntable 16 and cage 12 and they are returned to the vertical upright position by actuating the drive cylinder 26 to retract its rod which also drives the carrier assembly 32 to move the spray guns 30 & 108 to their retracted position where they clear the tub 20. The cage is then removed from the turntable by lifting it vertically upward. The apparatus 10 is then ready to receive another cage with fasteners to be coated.

The liquid coating on the fasteners is then cured to a dry film adhered to them preferably by heating the fasteners to a predetermined temperature for a predetermined period of time.

I claim:

1. An apparatus for applying a liquid coating on fasteners with an internal blind recess, comprising, a base, a turntable pivotally carried by said base and constructed and arranged to receive a hollow cage with a generally cylindrical side wall for rotating the cage about the axis of its side wall, a drive operably connected with said turntable for rotating it, an actuator operably connected with said turntable for pivotally moving said turntable to a first position wherein the axis of rotation of a cage carried by said turntable extends generally vertically and to a second position wherein such axis of rotation is inclined at an acute included angle to the vertical in the range of about 25° to 65°, and a spray gun for liquid coating constructed and arranged when in use to spray liquid coating into a cage carried and rotated by the turntable and onto circulating fasteners received therein when the cage and said turntable are disposed in the second position thereof and are being rotated by said drive.

2. The apparatus of claim 1 which also comprises, a carrier arm pivotally carried by said base, having said spray gun mounted thereon, and being movable to dispose said spray gun and arm in a first position spaced from the cage and turntable when they are in their first position, and to a second position to dispose said spray gun adjacent the cage and its axis of rotation when the cage and said turntable are in their second position and liquid coating is being discharged from said spray gun while the cage is rotating to apply the liquid coating to circulating fasteners received in the cage.

3. The apparatus of claim 2 wherein said arm is operably connected with said actuator to move said arm to its first and second positions in conjunction with movement of the cage and said turntable by said actuator to their first and second positions.

4. The apparatus of claim 1 which also comprises a tub having a bottom underlying said turntable and a side wall encircling and spaced from the side wall of a cage received on said turntable, and a duct operably connected with said tub for exhausting air through said tub at least when liquid coating is being discharged from said spray gun into the cage and onto circulating fasteners received in the cage.

5. The apparatus of claim 1 wherein said drive when in operation rotates said turntable and the cage at a speed in the range of 1 to 30 rpm at least while liquid coating is being discharged from said spray gun.

6. The apparatus of claim 1 wherein when said turntable and the cage are in their second position and said drive is rotating them at a speed in the range of 1 to 30 rpm, liquid coating is discharged from said spray gun for a period of time of about 30 seconds to 120 seconds.

7. The apparatus of claim 19 wherein said spray gun discharges liquid coating at the rate by volume of about 1500 to 3000 milliliters per hour.

* * * * *